United States Patent [19]

Elsaesser et al.

[11] 4,060,980

[45] Dec. 6, 1977

[54] STALL DETECTOR FOR A GAS TURBINE ENGINE

[75] Inventors: Fred L. Elsaesser, Glastonbury; Joseph H. Hall, East Hartford, both of Conn.

[73] Assignee: United Technologies Corporation, Hartford, Conn.

[21] Appl. No.: 633,309

[22] Filed: Nov. 19, 1975

[51] Int. Cl.[2] ..... F02C 9/02; F02C 9/14

[52] U.S. Cl. ..... 60/39.03; 60/39.27; 60/39.28 R; 60/39.28 T; 60/39.29

[58] Field of Search ..... 60/39.02, 39.03, 39.29, 60/39.27, 39.28 R, 39.28 T; 340/27 SS; 73/117.3

[56] References Cited

U.S. PATENT DOCUMENTS

| | | | |
|---|---|---|---|
| 3,133,416 | 5/1964 | Mock | 60/39.29 X |
| 3,172,259 | 3/1965 | North | 60/39.29 X |
| 3,513,899 | 5/1970 | Paduch | 60/39.29 X |
| 3,759,037 | 9/1973 | Kiscaden | 60/223 X |
| 3,852,958 | 12/1974 | Adams | 60/39.28 R |
| 3,867,717 | 2/1975 | Moehring | 60/39.28 R |
| 3,868,625 | 2/1975 | Speigner | 60/223 X |

*Primary Examiner*—Clarence R. Gordon
*Attorney, Agent, or Firm*—Norman Friedland

[57] ABSTRACT

Stall is detected by monitoring the minimum fuel flow schedule of a gas turbine engine fuel control and another parameter which includes (1) the fuel control acceleration schedule, (2) turbine temperature (inlet or exit) or (3) engine pressure (compressor discharge or burner) and computes these signals so that when both the control fuel metering valve is at its minimum stop position (minimum fuel flow) and one of the following conditions exists, (1) turbine temperature exceeds a predetermined level, (2) the rate of change of pressure exceeds a predetermined negative rate, or (3) the fuel control is on or in proximity to the acceleration schedule, an output will be manifested.

21 Claims, 5 Drawing Figures

STALL DETECTOR FOR A GAS TURBINE ENGINE

BACKGROUND OF THE INVENTION

This invention relates to means for detecting stall in a gas turbine engine and more particularly to a stall detection system that utilizes the existing engine fuel control together with another parameter.

As is well known, stall is a phenomenon that may occur in the compressor of a gas turbine engine which, if allowed to persist unabated, would impair engine performance and/or lead to the destruction of the engine. While the theory of stall is not completely understood, suffice it to say that stall is that effect occasioned when sufficient number of compressor blades stall and a momentary reversing of the airflow occurs through the compressor. This causes compressor discharge pressure to drop very rapidly and sometimes results in continual pressure oscillations until some corrective action is taken.

The art has seen a number of methods intended to either sense when stall is imminent and warn the pilot so that he can take corrective action or design the engine controls such that the area of engine operation where stall is likely to occur is avoided.

For example, fuel controls limit the amount of fuel admitted to the engine during acceleration so as to accelerate along a predetermined acceleration schedule that accounts for stall. Another method, which may be contemporaneously employed with this acceleration scheduling system, is to measure compressor discharge pressure and open compressor bleed valves whenever a predetermined compressor pressure change or rate of change occurs. And still another method which is described in U.S. Pat. No. 3,867,717 and granted to John Theodore Moehring and Vigil Willis Lawson on Feb. 18, 1975 is the utilization of computed compressor pressures and turbine or exit temperatures as a means for determining when stall is present.

While such stall detection and prevention means as described above may be effective for certain engines and/or their applications they are not always effective for other engines and/or their applications. For example, it may happen that under the same values of the computed compressor pressures or their rates and turbine temperatures or their rates another engine operation may occur which would lead to a false indication of stall; or the monitoring of the parameter may not be readily accessible or the inclusion of the sensing probes may interfere with the gas path and impair engine performance. Therefore the selection of the stall controller comes down to what stall system is best for that engine and its applications, what parameters are readily accessible, which system will provide the highest degree of accuracy, which one is fastest and a host of other considerations.

This invention contemplates monitoring the minimum stop position of the engine's fuel metering valve or other indicator of minimum fuel flow and another parameter, namely rate of change of burner or compressor discharge pressure, or the inlet or exit temperature of the turbine or the acceleration schedule produced by the fuel control.

These values will be computed so that two signals will be admitted to an "AND" gate that will produce the output signal indicative of stall whenever the fuel control calls for the minimum fuel flow and any one of the following conditions exist:

1. the decay rate of pressure of either the air discharging from the compressor or in the burner is at a predetermined value, or alternatively
2. the inlet or exit temperature of the turbine is at an abnormally high value, or alternatively
3. the fuel control is on the acceleration schedule.

The stall warning system requires both signals to be at a predetermined condition before the stall warning signal will be manifested.

In any stall control system that senses when stall is present the computed stall signal can either be utilized to provide a warning signal to the aircraft pilot, as by a visual or sound signal so that he can take corrective action as by retarding the power lever or the signal can be utilized to initiate corrective action in one of the following ways.

1. de-rich engine fuel flow
2. shutoff fuel
3. open compressor bleeds
4. change compressor stator vane angle
5. change aircraft inlet geometry
6. change engine outlet geometry Furthermore the signal can be incorporated in a system that would initiate an automatic stall recovery sequence by shutting-off fuel, start ignition and reinitiate fuel flow in a timed sequence.

SUMMARY OF THE INVENTION

An object of this invention is to provide an improved stall warning system for an axial flow gas turbine engine.

A still further object of this invention is to provide a stall warning system that utilizes the minimum fuel flow schedule of the engine's fuel control together with another parameter solely when predetermined conditions of each signal is satisfied.

A still further object of this invention is to provide a stall warning signal upon satisfying the condition that the fuel metering valve of the engine's fuel control is at the minimum fuel stop position and any one of the following conditions is present, (1) the decay rate of $P_3$ or $P_B$ is at a predetermined value, or (2) TIT or TET is abnormally high, or (3) the fuel control is on or near the acceleration schedule.

Other features and advantages will be apparent from the specification and claims and from the accompanying drawings which illustrate an embodiment of the invention.

DESCRIPTION OF THE PREFERRED EMBODIMENT

Figure 1:
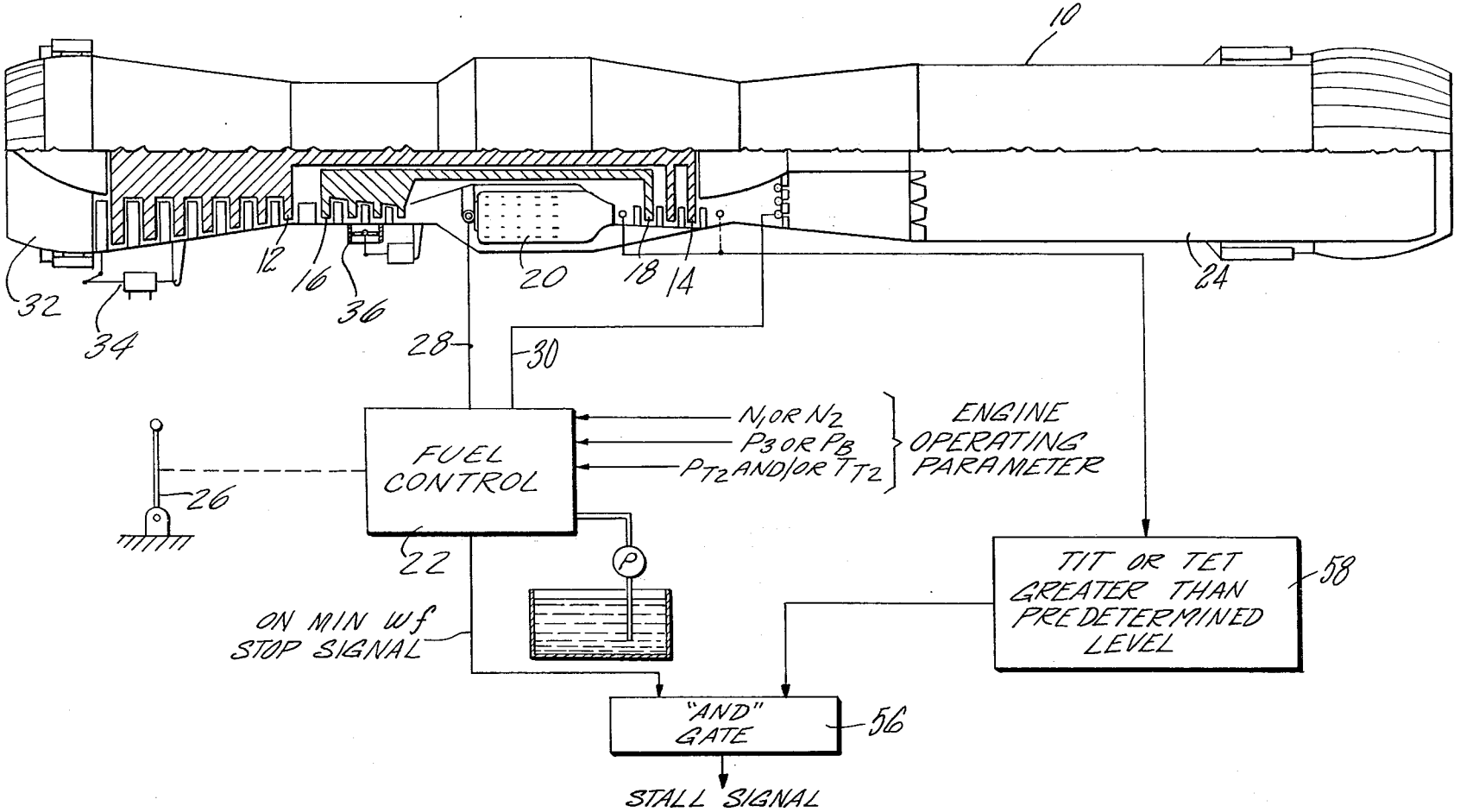
FIG. 1 is a schematic representation, partially in section of a gas turbine engine and a schematic representation of a stall warning system connected thereto.

For the purposes of this description, the gas turbine engine illustrated in FIG. 1 typifies any number of different types of engines where this invention may be utilized. Such engines may include, as for example, the JT-3D, JT-8D, JT-9D, JT-12, TF-30 manufactured by the Pratt & Whitney Aircraft Division of United Technologies Corporation, but are not limited thereto. Suffice it to say that this invention is applicable where stall is a problem which is generally the case in any axial flow compressor. Also, the fuel control for the purpose of this invention may include any type, be it electronic, hydromechanical or the like that serves to meter fuel to the engine. Such fuel controls may include, for example, the JFC-12, JFC-25, JFC-60, JFC-68 manufactured by the Hamilton Standard Division of United Technologies Corporation or the AJ-H1, CJ-G5, CJ-G7, CJ-G8 manufactured by the Bendix Energy Controls Division of the Bendix Corporation but are not limited thereto.

Essentially, the gas turbine engine exemplified by FIG. 1 is a twin spool axial flow gas turbine engine having an engine casing 10 in which the low pressure compressor 12 and driving turbine 14 and high pressure compressor 16 and its driving turbine 18 are rotary mounted. The burner section 20 burns fuel metered thereto by fuel control illustrated by the block 22 and the generated gases after driving the turbines are exhausted to the afterburner 24 which may or may not be included. In this scheme fuel control 22 which responds to power lever 26 and other engine operating parameters in a well known manner supply fuel through lines 28 and 30 to the burner section of the core engine and the afterburner.

Depending on the particular engine and its application it may include a variable geometry inlet duct 32, variable compressor stators generally illustrated by reference numeral 34, and/or compressor bleeds, generally illustrated by reference numeral 36.

Figure 2:
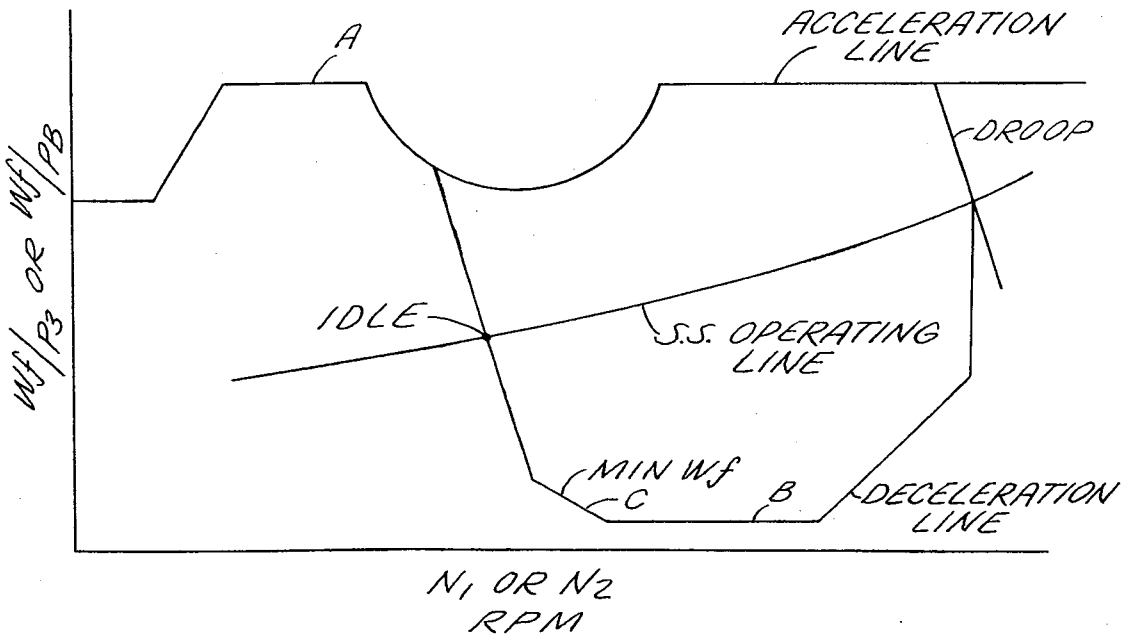
FIG. 2 is a graphical representation of a typical engine's operating line and its control functions it terms of $W_f/P$ vs N.

A typical fuel control, as those mentioned above, or the one described in U.S. Pat. No. 2,822,666 granted to S. G. Best and assigned to the same assignee, all of which are incorporated by reference herein, sense certain control parameters and compute them so as to manifest the control schedules depicted by the graph in FIG. 2. As noted, this graph which is a plot of $W_f/P_3$ or $W_f/P_B$ vs. $N_1$ or $N_2$ shows the acceleration line A which serves to prevent the engine from exceeding a predetermined temperature to assure that the engine parts will not exceed their temperature limits, and that the compressor will not operate in the stall region. Also, the control provides the typical deceleration schedule and the minimum $W_f$ represented by the lines B + C, respectively.

In the fuel controls noted above, the acceleration schedule is produced by a three-dimensional cam that responds in one direction to speed of the compressor and in another direction to compressor inlet temperature. The minimum $W_f$ is generally manifested by a stop which prevents the main fuel metering valve from closing-off. Since the pressure drop across the metering valve is held constant, the fuel flow, when on the stop, will be constant.

Figure 3:
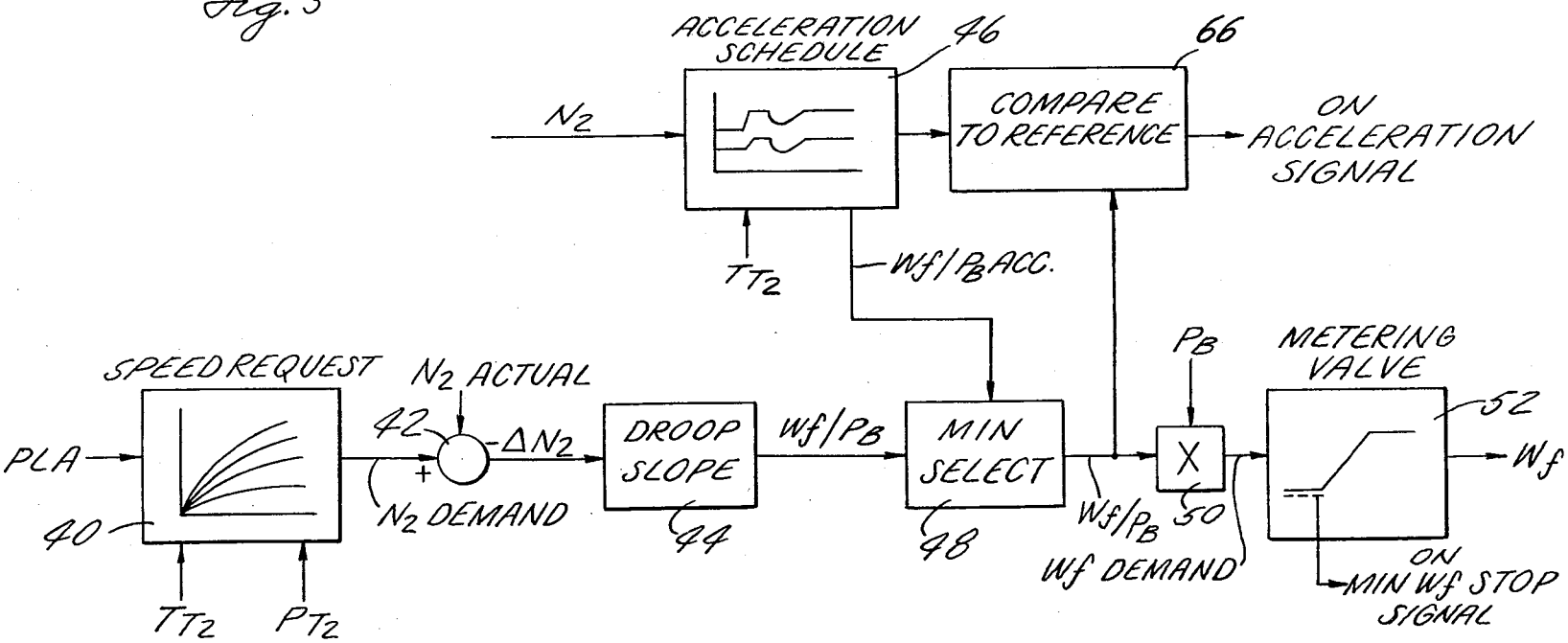
FIG. 3 is a block diagram typifying a fuel control system for providing the control according to the schedule of FIG. 2.

This best can be seen by referring to FIG. 3 which shows by block diagram the major functions of a typical $W_f/P_B$ type of fuel control. As noted, the speed request function generator 40 responding to the position of the power lever 26 (PLA) which may be biased by total compressor inlet temperature ($T_{T2}$) and/or total compressor inlet pressure ($P_{T2}$) produces a compressor speed (high compressor $N_2$) demand signal. Comparator 42 compares the actual $N_2$ and produces a delta ($\Delta$) $N_2$ signal indicative of the difference between the demand and actual.

While the controls mentioned above are droop governing this is not a limitation, as isochronous governing may be equally employed without affecting the invention. The gain or droop of the signal produced by the governor and illustrated by box 44 produces an output signal that is related in terms of a $W_f/P_B$ desired schedule signal. This corresponds to the abscissa of the graph illustrated in FIG. 2.

Concomitantly, the computing section of the fuel control monitoring $N_2$ and $T_{T2}$ produces an acceleration schedule 46 and as mentioned above in the case of the hydromechanical controls noted above this is the function of the three-dimensional cam. Both the steady-state $W_f/P_B$ represented by the output of droop slope 44 and the scheduled $W_f/P_B$ acceleration represented by the output of 46 are passed through the minimum selector 48 allowing the lower of the two to pass to the multiplier 50.

Multiplier 50 in a well known manner multiplies either the $W_f/P_B$ droop signal or $W_f/P_B$ acceleration signal by actual $P_B$ to produce a $W_f$ demand signal. The $W_f$ demand signal, in turn, positions the metering valve 52 to meter the amount of fuel dictated by the computer of the fuel control. As noted in box 52 the travel of fuel metering valve is limited by a stop represented by the dash line E.

The description above for both a typical engine and a typical fuel control do not form a part of this invention, except for the fact that existing components may be utilized to execute this invention. Hence, a detailed description of both the engine and fuel control are omitted for the sake of convenience and simplicity, but for further details reference should be made to the literature of the engine and the fuel controls already mentioned herein.

It is apparent from the foregoing that this invention contemplates utilizing the minimum fuel flow of the fuel metering valve of the fuel control. This can be accomplished in one of several ways, as by illustration without limitation, measuring the physcial position of the metering valve, as say when it bears against the minimum fuel flow stop or measuring the servo pressure of the metering valve actuating servo which would also be an indication of when the valve is at the minimum fuel flow, or measuring flow itself. The particular means utilized to obtain this signal will be generally dictated by the particular fuel control model, but it is to be understood that whatever means are employed, this invention contemplates utilizing an existing and accessible signal which either is readily available or can be made available with only minor modifications.

As can be viewed in FIG. 1, the "AND" gate 56 which is commercially available serves to produce an output signal indicative of a stall condition solely when two input parameters are present. One of the parameters, as mentioned immediately above is a signal indicative of when the fuel control is metering the minimum fuel flow or is on minimum flowstop as represented by curve C of the graph of FIG. 2.

Suitable temperature sensor, whether it be thermocouples, pyrometers or other well known means serve to measure TIT or TET and a signal generator 58 responsive thereto will produce an output signal when it senses a value indicative of an abnormally higher temperature which signal will be imposed as the other input signal of "AND" gate 56. The temperature sensor can be located upstream of the turbine (TIT) or downstream (TET) thereof. Some engines come equipped with sensors which can likewise be utilized for this purpose.

Figure 4:
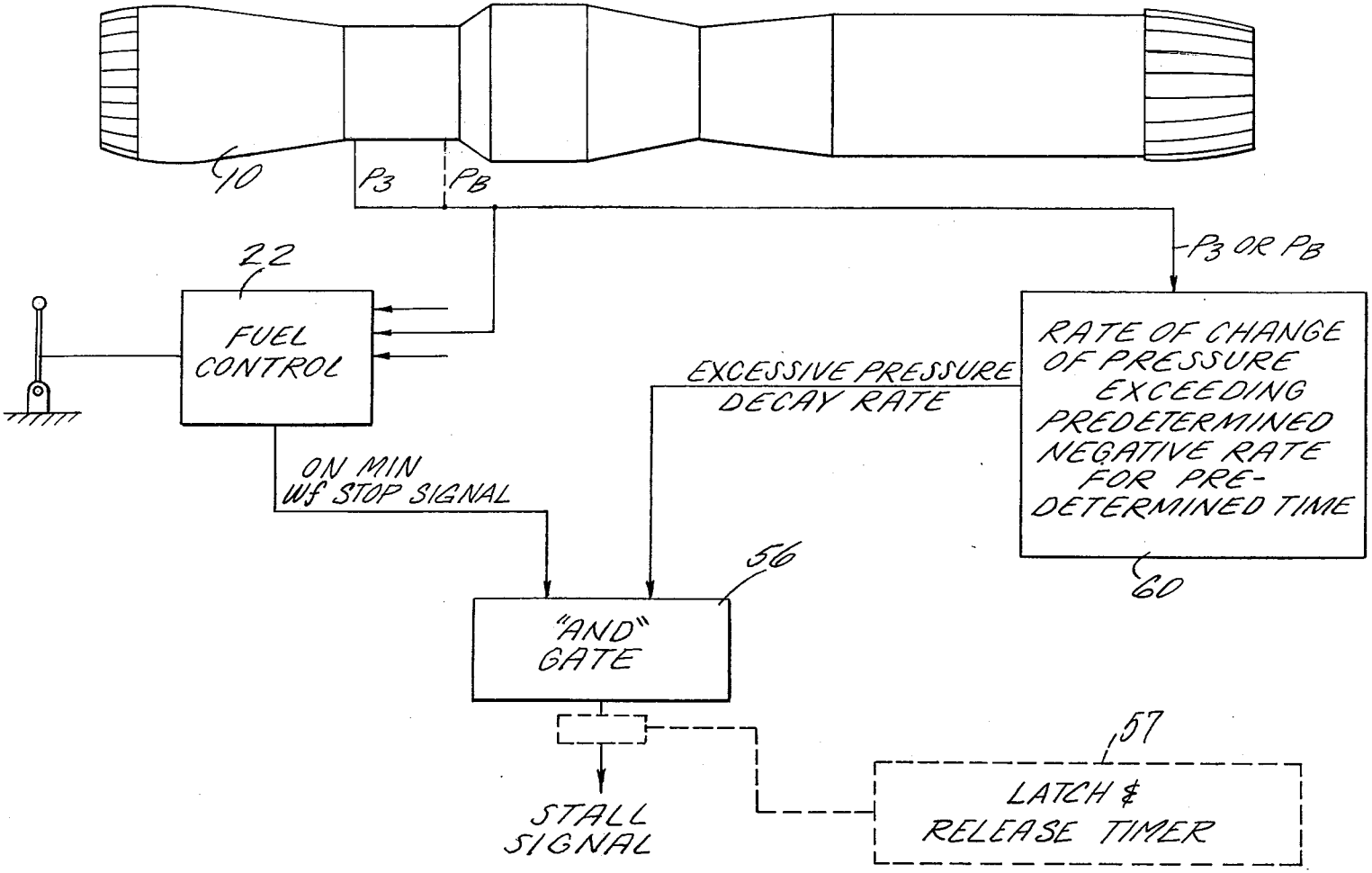
FIG. 4 is a schematic representation of a stall warning system.

FIG. 4 represents still another embodiment wherein the minimum fuel flow stop signal is compared to an excessive decay rate of the compressor discharge pressure ($P_3$ or $P_B$). In a twin spool engine as shown, $P_3$ would be the pressure intermediate the low compressor and high compressor and $P_B$ would be indicative of the pressure of the air discharging from the high compressor. In this embodiment a pressure sensor would be converted to a signal that would measure its rate of change. A suitable rate of change computer represented by box 60 would, in turn, produce an output signal solely when the negative rate shows the pressure decay rate is excessive. When both these conditions exist, that is, the fuel control is on the minimum fuel flow stop and the pressure decay rate is excessive, the "ANd" gate will generate an output signal indicative of a stall.

It may be desirable to hold the stall signal a predetermined time so as to prevent, for example, the stall signal from deactivation if for instance the power lever is pulled to idle or cut-off or speed decay rate stabilizes. A suitable commerically available timer and release mechanism schematically represented by box 57 serves this purpose.

Figure 5:
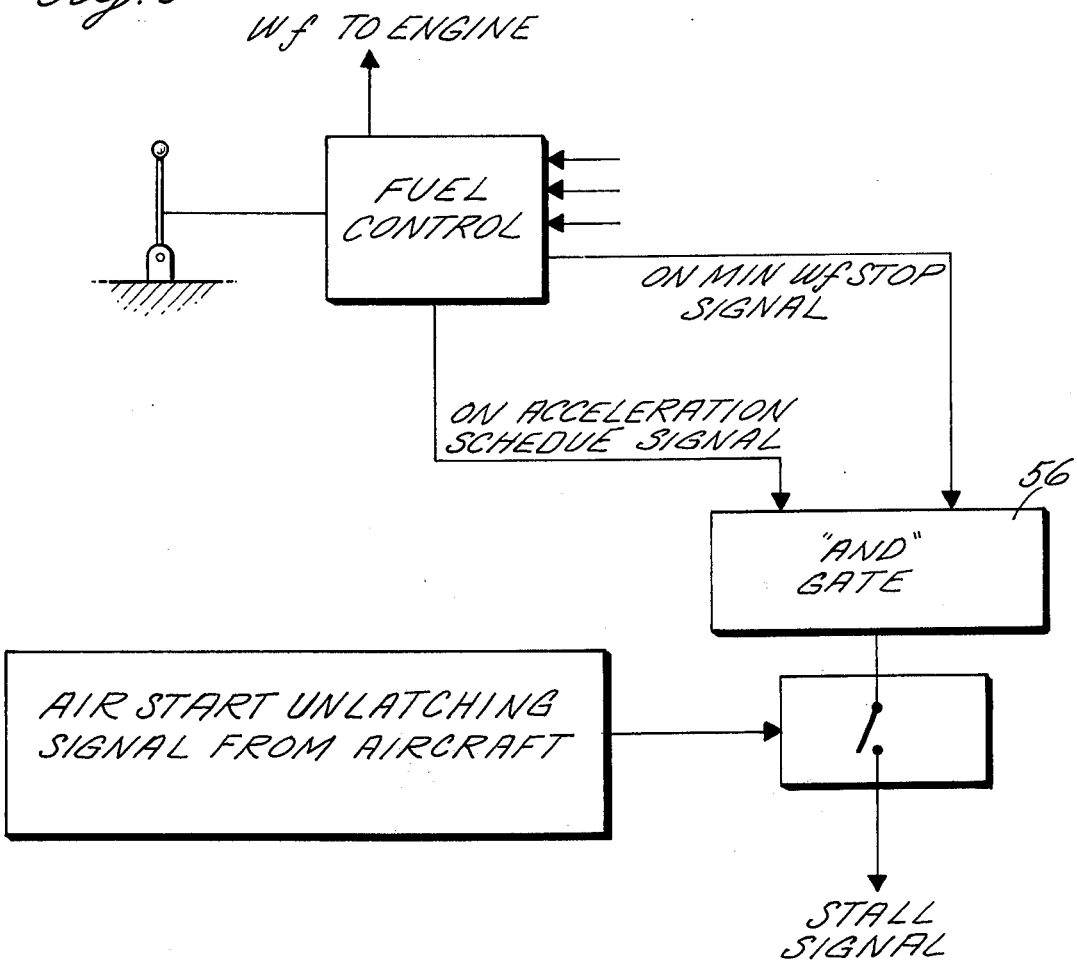
FIG. 5 is a schematic representation of another embodiment of a stall warning system.

FIG. 5 is another embodiment where the minimum fuel flow schedule or stop position of the fuel control is utilized as a control parameter for the stall detector. Referring to FIG. 5 where like numerals designate previously described elements, "AND" gate 56 receives a minimum fuel flow stop signal from the fuel control.

An on acceleration signal also manifested by the fuel control is the other control parameter and when predetermined conditions of both of those parameters are evident they are presented as inputs to "AND" gate 56, and it in turn, will produce an output signal indicative of when stall is imminent or present.

As can be seen of FIG. 3 inasmuch as the fuel control schedules acceleration means are incorporated to readily adapt existing fuel controls to produce a signal indicative of when it is on or in proximity to the acceleration schedule. For example any of the types of controls noted above, can easily be modified by sensing when the cam follower of the three-dimensional cam is on the acceleration schedule profile or in proximity thereto. As schematically represented in FIG. 3 comparator 66 compares the schedule acceleration signal which is in terms of $W_f/P_B$ and the $W_f/P_B$ signal being imparted to multiplier 50 (the output of minimum selector 48) and when both values are equal will be indicative of when the fuel control is on the acceleration schedule.

It will be apparent from the foregoing that whenever the fuel control is on the acceleration schedule and the metering valve is on the minimum fuel flow stop, an abnormal condition during normal engine operation, stall or imminent stall will result.

In the event the engine shuts off during flight and a restart is made it would be necessary to decouple the stall detector during this operation. Preferably this would be pilot operated by energizing suitable latching and unlatching mechanism represented by box 76.

By virtue of this invention stall detection is manifested by monitoring the metering valve or other means indicative thereof and producing an output signal indicative of when the fuel control is on the minimum fuel flow schedule and monitoring another engine operating parameter and computing it so that whenever the temperature of the turbine inlet or exit is abnormally high, or when the fuel control is on the acceleration schedule or the rate of decay of the compressor pressure is excessive a stall warning signal will be produced.

In certain engines the minimum fuel flow may be set too high under certain operating conditions and the stall signal may be utilized to re-set the minimum fuel flow to a lower value when the compressor is in stall. Otherwise, the amount of fuel permitted by the minimum fuel flow schedule before it was changed could cause the engine to overheat, even to an extent of burning it out.

It should be understood that the invention is not limited to the particular embodiments shown and described herein, but that various changes and modifications may be made without departing from the spirit or scope of this novel concept as defined by the following claims.

We claim:

1. Stall detector for a gas turbine engine having a compressor, burner and turbine, in combination with a fuel control having a fuel metering valve regulating the flow of fuel to the burner and independent coordinating means providing a schedule for the minimum fuel flow metered by said fuel metering valve, said stall detector including means responsive to said minimum fuel flow schedule for producing a first signal whenever said fuel control is on the minimum fuel flow schedule, means responsive to another operating parameter for producing a second signal when said parameter reaches an abnormal condition of engine operation and means responsive to both said first signal and said second signal for producing a third signal indicative of stall solely when said first signal and said second signal are received.

2. A stall detector as in claim 1 wherein said minimum flow schedule signal is when said metering valve bears against the minimum fuel flow stop.

3. Stall detector for an axial flow gas turbine engine having a compressor, burner and turbine, in combination with a fuel control having a fuel metering valve regulating the flow of fuel to the burner and independent coordinating means providing a schedule for the minimum fuel flow metered by said fuel metering valve, said stall detector including means responsive to said minimum fuel flow schedule for producing a first signal whenever said fuel control is on the minimum fuel flow schedule, means responsive to the rate of change of pressure of said compressor for producing a second signal when the rate of pressure decay exceeds a predetermined value and means responsive to both said first signal and said second signal for producing a third signal indicative of stall solely when said first signal and said second signal are received.

4. A stall detector as in claim 3 wherein the engine is of the twin spool design and the pressure sensed is the pressure intermediate the low compressor and high compressor.

5. A stall detector as in claim 3 wherein said minimum flow schedule signal is when said metering valve bears against the minimum fuel flow stop.

6. Stall detector for an axial flow gas turbine engine having a compressor, burner and turbine, in combination with a fuel control having a fuel metering valve regulating the flow of fuel to the burner and independent coordinating means providing a schedule for the minimum fuel flow metered by said fuel metering valve, said stall detector including means responsive to said minimum fuel flow schedule for producing a first signal whenever said fuel control is on the minimum fuel flow schedule, means for sensing the temperature of the turbine, a second signal, a comparator means responsive to said turbine temperature comparing its value with a reference value to produce a second signal indicative of an abnormally high temperature and gate means responsive to both said first signal and said second signal for producing a third signal indicative of stall solely when said first signal and said second signal are received by said gate means.

7. A stall detector as in claim 6 wherein the temperature sensed is turbine inlet temperature.

8. A stall detector as in claim 6 wherein the temperature sensed is turbine exit temperature.

9. A stall detector as in claim 6 wherein said minimum flow schedule signal is when said metering valve bears against the minimum fuel flow stop.

10. Stall detector for an axial flow gas turbine engine having a compressor, burner and turbine, in combination with a fuel control having a fuel metering valve regulating the flow of fuel to the burner and independent coordinating means providing a schedule for the minimum fuel flow metered by said fuel metering valve, and independent coordinating means providing a schedule for engine acceleration by limiting the fuel metering valve, said stall detector including means responsive to said minimum fuel flow schedule for producing a first signal whenever said fuel control is on the minimum fuel flow schedule, means responsive to said acceleration schedule for producing a second signal when the fuel control is operating on or in proximity to the acceleration schedule and means responsive to both said first signal and said second signal for producing a third signal indicative of stall solely when said first signal and said second signal are received.

11. A stall detector as in claim 10 wherein said fuel control includes means responsive to both compressor speed and compressor inlet temperature for producing an acceleration schedule and means responsive to when said fuel control is in said acceleration schedule.

12. A stall detector as in claim 11 wherein said means responsive to compressor speed and compressor inlet temperature produces a signal in ratio units indicative of $W_f$(in flow of fuel in pounds per hour) and $P_B$ (in pressure in pounds per square inch absolute) and the actual $P_B$ is multiplied by said ratio units signal to control said metering valve.

13. A stall indicator as claimed in claim 12 including comparator means comparing the actual $W_f/P_B$ signal of the multiplier to the $W_f/P_B$ signal of the acceleration schedule and producing an on acceleration signal whenever the $W_f/P_B$ signal to the multiplier equals the acceleration schedule value.

14. The method of detecting stall in a gas turbine axial flow engine which includes a fuel control that schedules engine operation and particularly the minimum fuel flow comprising the steps of:

measuring the fuel control schedule so as to produce an output signal whenever the fuel metered to the engine is at the minimum value, measuring a parameter other than the minimum flow schedule which parameter would be abnormal relative to engine operation when the fuel control is on the minimum flow schedule to produce an output signal when that parameter is abnormal under those circumstances, combining both the output signals obtained in the steps of measuring to produce an output signal solely when both signals are present to indicate a stall condition which signal can be used as a warning or to initiate stall corrective action.

15. The method of detecting stall in a gas turbine axial flow engine which includes a fuel control that schedules engine operation and particularly the minimum fuel flow comprising the steps of:

measuring the fuel control schedule so as to produce an output signal whenever the fuel metered to the engine is at a minimum value, measuring the air pressure at or in proximity to the compressor so as to produce an output signal whenever its decay rate of change reaches a predetermined value, combining both the output signals obtained in the steps of measuring to produce an output signal indicative of a stall condition which signal can be used as a warning or to initiate stall corrective action.

16. The method of claim 15 wherein said engine is a twin spool design and the pressure is intermediate the low compressor and high compressor.

17. The method of claim 15 wherein the pressure measured in the steps of measuring is compressor discharge pressure.

18. The method of detecting stall in a gas turbine axial flow engine which includes a fuel control that schedules engine operation and particularly the minimum fuel flow comprising the steps of:

measuring the fuel control schedule so as to produce an output signal whenever the fuel metered to the engine is at the minimum value, measuring the temperature at or in proximity to the turbine so as to produce an output signal whenever its value reaches an abnormally high predetermined value, combining both the output signals obtained in the steps of measuring to produce an output signal indicative of a stall condition which signal can be used as a warning or to initiate stall corrective action.

19. The method of claim 18 wherein the temperature measured is the temperature at the inlet of the turbine.

20. The method of claim 18 wherein the temperature measured in the step of measuring is the temperature at the exit of the turbine.

21. The method of detecting stall in a gas turbine axial flow engine which includes a fuel control that schedules engine acceleration operation and the minimum fuel flow comprising the steps of:

measuring the fuel control schedule so as to produce an output signal whenever the fuel metered to the engine is at the minimum value, measuring the fuel control schedule so as to produce an output signal whenever the fuel control is scheduling acceleration, combining both the output signals obtained in the steps of measuring to produce an output signal solely when both signal are present which indicates a stall condition which signal can be used as a warning or to initiate stall corrective action.

* * * * *